US007145426B2

(12) United States Patent
Kawai et al.

(10) Patent No.: US 7,145,426 B2
(45) Date of Patent: Dec. 5, 2006

(54) IGNITION COIL FOR INTERNAL COMBUSTION ENGINE

(75) Inventors: Kazuhide Kawai, Kariya (JP); Shouichi Takeyama, Hashima (JP); Masahiko Aoyama, Kariya (JP)

(73) Assignee: Denso Corporation, Kariya (JP)

( * ) Notice: Subject to any disclaimer, the term of this patent is extended or adjusted under 35 U.S.C. 154(b) by 70 days.

(21) Appl. No.: 11/115,348

(22) Filed: Apr. 27, 2005

(65) Prior Publication Data

US 2005/0248427 A1 Nov. 10, 2005

(30) Foreign Application Priority Data

May 10, 2004 (JP) ..... 2004-140000
Mar. 9, 2005 (JP) ..... 2005-065458

(51) Int. Cl.
*H01F 27/02* (2006.01)

(52) U.S. Cl. ..... 336/90; 336/92; 336/96

(58) Field of Classification Search ..... 336/90, 336/92, 96; 123/634–635
See application file for complete search history.

(56) References Cited

U.S. PATENT DOCUMENTS 6,469,608 B1 * 10/2002 Shimoide et al. ..... 336/90
6,508,239 B1 * 1/2003 Shimada et al. ..... 123/634
6,781,500 B1 8/2004 Kawai et al. ..... 336/198
7,013,883 B1 * 3/2006 Shimada et al. ..... 123/634
7,071,804 B1 * 7/2006 Kawano et al. ..... 336/198
7,091,809 B1 * 8/2006 vom Schloss et al. ..... 336/90
2004/0104796 A1 6/2004 Kawai et al. ..... 336/90

FOREIGN PATENT DOCUMENTS

JP 10-89219 4/1998

* cited by examiner

*Primary Examiner*—Anh T. Mai
(74) *Attorney, Agent, or Firm*—Nixon & Vanderhye P.C.

(57) ABSTRACT

An ignition coil for an internal combustion engine has a first housing, a second housing, a holder, an insulating resin and a crack extension restrictor. The first housing encloses a center core, a primary coil and a secondary coil. The second housing has an install portion and a cylinder-shaped fitting portion fitted to a top cylindrical portion of the first housing. The holder is laid over top ends of the primary and secondary coils. The insulating resin is charged in an annular cavity defined at least by uppermost portions of the primary and secondary coils, the fitting portion and the holder and in contact with the fitting portion. The crack extension restrictor is formed by a part of the fitting portion and a part of the holder and disposed above the fitting faces of the fitting portion and the top end portion.

10 Claims, 4 Drawing Sheets

IGNITION COIL FOR INTERNAL COMBUSTION ENGINE

CROSS REFERENCE TO RELATED APPLICATION

This application is based upon and claims the benefit of priority of Japanese Patent Applications No. 2004-140000 filed on May 10, 2004 and No. 2005-065458 filed on March 9, the contents of which is incorporated herein by reference.

FIELD OF THE INVENTION

The present invention relates to an ignition coil for an internal combustion engine capable of restricting a crack generation in insulating resin charged therein.

BACKGROUND OF THE INVENTION

Currently, internal combustion engines for vehicles have varied specifications such as a length, an installing orientation and a connector's orientation. Some stick ignition coils have two housings separately formed from each other for enclosing a coil and an igniter to adapt themselves to the varied specifications of the engines US-6,781,500-B2 and US-2004/0104796-A1 (JP-2003-303724-A) discloses an ignition coil, as shown in FIG. 9, that has a first housing 150 and a second housing 155. The first housing encloses a center core 151, a primary coil 152, a secondary coil 153, etc. therein. The second housing 155 encloses an igniter 156, a terminal 157, etc. therein. The second housing 155 has a cylinder-shaped fitting portion 155*a* fitted to an outer circumferential face of a cylinder-shaped cylinder top portion 150*a* of the first housing 150. Insulating resin 161, 162 fills gaps between the center core 151, the primary coil 152 and the secondary coil 153 in the first housing 150 and a cavity around the igniter 156 in the second housing 156.

To assemble the first housing 150 and the second housing 155 into the ignition coil, an inner circumferential face of the fitting portion 155*a* of the second housing 155 is press-fitted to the outer circumferential face of the cylinder top portion 150*a* of the first housing 150, and the primary coil 152 and the secondary coil 153 are electrically connected to the igniter 156, etc. Then, liquid epoxy resin is charged into the second housing 155 to fill the gaps between the center core 151, the primary coil 152 and the secondary coil 153 in the first housing 150 and the cavity around the igniter 156 in the second housing 156. A heating process cures the liquid epoxy resin charged in the gaps and the cavity.

The above conventional ignition coil, however, has not enough measures against an exfoliation (a crack generation) in the insulating resin 161. The insulating resin 161 suffers a thermal stress in a radial direction of the ignition coil in accordance with the engine's operation. The thermal stress may generate a slight gap between the insulating resin 161 and the top cylindrical portion 150*a* or between the insulating resin 161 and the fitting portion 155*a*. Then, the slight gap at a top end of fitting faces of the cylinder top portion 150*a* and the fitting portion 155*a* may develop into the exfoliation (the crack) at a adhering faces of the fitting portion 155*a* and the insulating resin 161.

If the crack extends closer to the igniter 156 and/or the terminal 157 in the second housing 155, the crack may extend into the insulating resin to reach a molding resin of the igniter 156 and/or the terminal 157. As a result, the crack may spoil a function of the igniter 156 and/or break the terminal 157.

SUMMARY OF THE INVENTION

The object of the present invention, in view of the above-described issues, is to provide an ignition coil for an internal combustion engine capable of restricting a crack extension in an insulating resin that starts at a top end of fitting faces of a cylinder top portion of a first housing and a fitting portion of a second housing and extends along an adhering faces of an inner circumferential face of the fitting portion and an outer circumferential face of the insulating resin toward an igniter and so on.

The ignition coil for the internal combustion engine has a cylinder-shaped first housing, a second housing, a holder, a ring-shaped insulating resin and a crack extension restrictor. The cylinder-shaped first housing encloses a center core, a primary coil disposed outside of the center core and a secondary coil disposed outside of the center core therein. The second housing has an install portion and a cylinder-shaped fitting portion fitted to an outer circumference of a top end portion of the first housing. The holder is laid over a top ends of the primary and secondary coils to define relative positions thereof. The ring-shaped insulating resin is charged in an annular cavity defined at least by an uppermost portions of the first and the second coil, the fitting portion of the second housing and the holder and in an intimate contact with the fitting portion at adhering faces. The crack extension restrictor is formed by a part of the fitting portion of the second housing and a part of the holder and disposed above the fitting faces to restrict a crack extension starting at a top end of the top end portion and extending along the adhering faces toward the install portion.

BRIEF DESCRIPTION OF THE DRAWINGS

Other objects, features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

Figure 1:
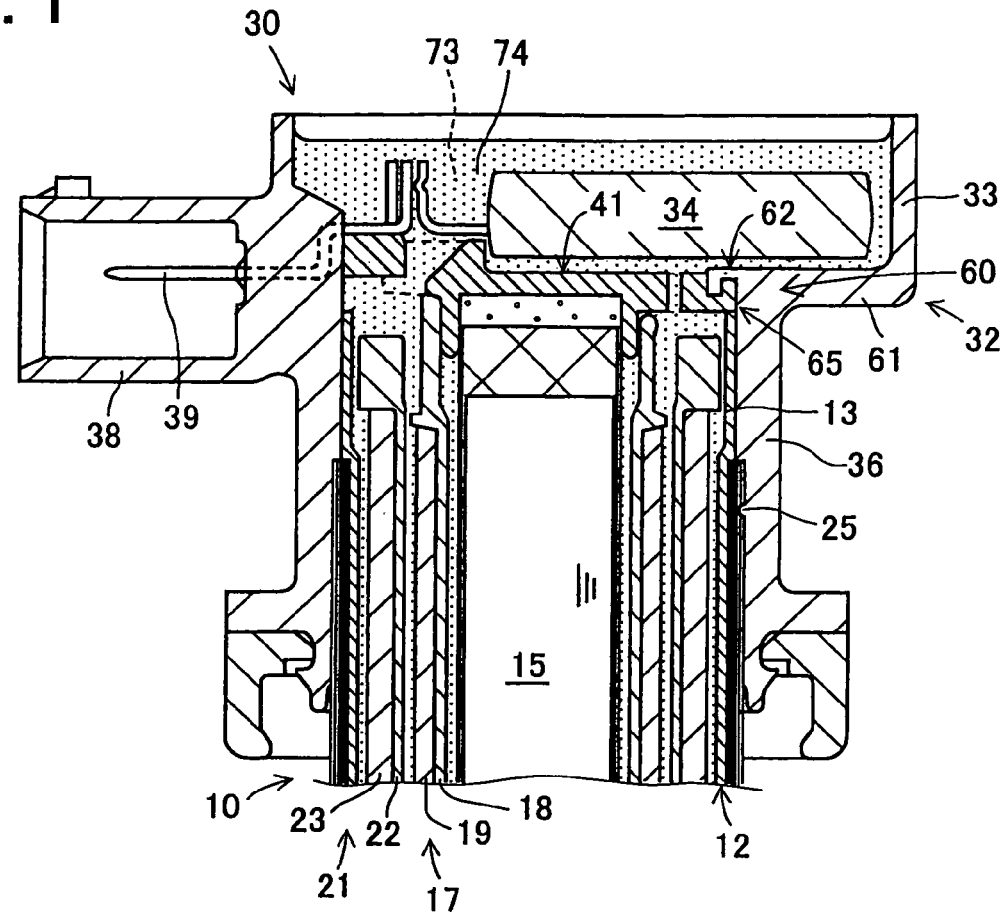
FIG. 1 is a cross-sectional view of an ignition coil for an internal combustion engine according to a first embodiment of the present invention.

An ignition coil for an internal combustion engine according to the present invention has a first housing, a second housing separately formed from the first housing and an insulating resin. The first housing defines a coil portion and encloses a primary coil and a secondary coil therein. The second housing defines a control portion and encloses an igniter and a terminal therein. The insulating resin is charged around fitting faces of a fitting portion of the second housing and a top portion (a cylinder top portion) of the first housing, especially above the cylinder top portion and inside of the fitting portion.

<Coil Portion>

The first housing in the coil portion has a slim cylindrical shape. The first housing disposes a center core at a central portion of a bore thereof and the primary and secondary coils around the center core. The primary coil may be disposed inside of the secondary coil or outside of the secondary coil. The first housing may hold an outer peripheral core on an inner circumferential face thereof or on an outer circumferential face thereof.

The insulating resin is charged in a cavity including a gap between an inner winding and an outer spool, a gap between an outer winding and the first housing, a gap between top ends of the primary and secondary coils and a holder or a fitting portion of the second housing, etc. It is desirable that an epoxy resin implementing the insulating resin has a coefficient of linear thermal expansion smaller than that of a polybutylene terephthalate (PBT) implementing the second housing and the holder.

<Control Portion>

The control portion includes the second housing, the igniter, etc. The second housing has an install portion and the fitting portion. In many embodiments, the install portion installs the igniter therein and the insulating resin is charged in a second cavity around the igniter. An inner circumferential face of the fitting portion is press-fitted to an outer circumferential face of the cylinder top portion of the first housing. In an assembly of the control portion, the primary coil, the secondary coil and the center core are located in the first housing, and the fitting portion of the second housing is press-fitted to the outer circumferential face of the cylinder top portion of the first housing. Alternatively, the igniter may be disposed outside of the install portion. In this case, the terminal connecting the primary and secondary coils to the igniter is disposed in the install portion.

<Holder>

The holder is made of PBT as well as the second housing. The holder has a disk shape as a whole, and disposed between top ends of the center core, etc. and the igniter in a longitudinal direction of the ignition coil. The holder is put above the top ends of the center core, the primary coil and the secondary coil to block a top end opening of the first housing. Thus, the holder defines an alignment of the center core, the primary coil, the secondary coil and the igniter relative to each other in radial and longitudinal directions of the ignition coil. Here, the holder is separately described from the first and second housings. The holder, however, may be regarded as a part of the coil portion or the control portion according to the present invention.

<Crack Extension Restrictor>

The ignition coil according to the present invention further has a crack extension restrictor for restricting a crack generation and extension in the insulating resin charged therein. The crack extension restrictor is specifically optimized for restricting a crack that starts at a top end of the fitting faces of the fitting portion of the second housing and the cylinder top portion of the first housing and extends along adhering faces of the inner circumferential face of the fitting portion and the insulating resin toward the igniter and/or the terminal. The crack extension restrictor is classified into three types as follows.

(a) First Type

A first type of the crack extension restrictor includes the holder. The holder is put on the top end opening of the first housing in which the center core, etc. has already installed. Alternatively, the holder may be attached on a lower face of the second housing then put on the top end opening of the first housing together with the second housing.

A part of the fitting portion of the second housing and a part of the holder form the crack extension restrictor laid over the top end of the fitting faces of the fitting portion and the cylinder top portion. Specifically, a first engaging portion protrudes radially inward over a part of the inner circumference of the second housing. A second engaging portion protrudes radially outward over a part of the outer circumference of the holder. Then the first and second engaging portions overlaps and engages with each other. It is not always necessary for the first and second engaging portions to engage with each other. The first and second engaging portions may just overlap to implement the crack extension restrictor. The second housing does not always need to include the igniter.

The crack extension restrictor overlaps the fitting faces or the cylinder top portion in the radial direction and is disposed above the fitting face or the top end of the top cylindrical portion in the longitudinal direction to restrict the crack extension.

(b) Second Type

A second type of the crack extension restrictor also includes the holder. A protruding portion protruding over a part of the fitting portion of the second housing or another protruding portion protruding over a part of the outer circumference of the holder forms the crack extension restrictor laid over the cylinder top portion, etc. of the second housing. The crack extension restrictor includes any one of the protruding portion of the fitting portion and the another protruding portion of the holder. The crack extension restrictor overlaps the fitting faces or the cylinder top portion in the radial direction and is disposed above the fitting faces or the top end of the top cylindrical portion in the longitudinal direction. The second housing may include or may not include the igniter.

(c) Third Type

A third type of the crack extension restrictor has the holder enclosing the igniter therein. The crack extension restrictor is disposed inside of the second housing and below the igniter. Specifically, the crack extension restrictor is embedded in the insulating resin or adhered on a lower face of the igniter, an upper face of the holder, etc. The crack extension restrictor overlaps the fitting faces or the cylinder top portion in the radial direction and is disposed above the fitting faces or the top end of the top cylindrical portion in the longitudinal direction. The second housing may include or may not include the holder.

<Adhesive Accumulation Cavity>

In the above-described first to three types of the crack extension restrictor, it is useful to provide the outer circumferential face of the cylinder top portion of the first housing with an adhesive accumulation cavity accumulating adhesive for adhering the fitting portion to the first housing. The adhesive accumulation portion may be implemented by a concavity or a plurality of concavities. The adhesive accumulation portion may be implemented by a groove or a plurality of grooves extending along a circumferential or a longitudinal direction of the top cylindrical portion.

<First Embodiment>

(Configuration)

As shown in FIG. 1, an ignition coil according to a first embodiment has the coil portion 10 disposed at a middle part in the longitudinal direction of the ignition coil, a control portion 30 disposed at an upper part of the ignition coil and a high voltage tower (not shown) disposed at a lower part of the ignition coil. The coil portion 10 includes the center core 15, the secondary coil 17 and the primary coil 21 enclosed in a cylinder-shaped first housing 12 and the outer peripheral core 25 fixed on the outer circumferential face of the first housing 12. The secondary coil 17 is disposed around the center core 15 and has a cylinder-shaped insulating secondary spool 18 and a secondary winding 19 wound on an outer circumferential face of the secondary spool 18. The primary coil 21 is disposed around the secondary coil 17 and has a primary spool 22 and a primary winding 23 configured in the same fashion as the secondary coil 22. The first housing 12 is provided with a depression on the outer circumferential face thereof to fit the outer peripheral core 25 thereon so that the outer peripheral core 25 faces the center core 15 in the radial direction of the ignition coil.

Figure 2:
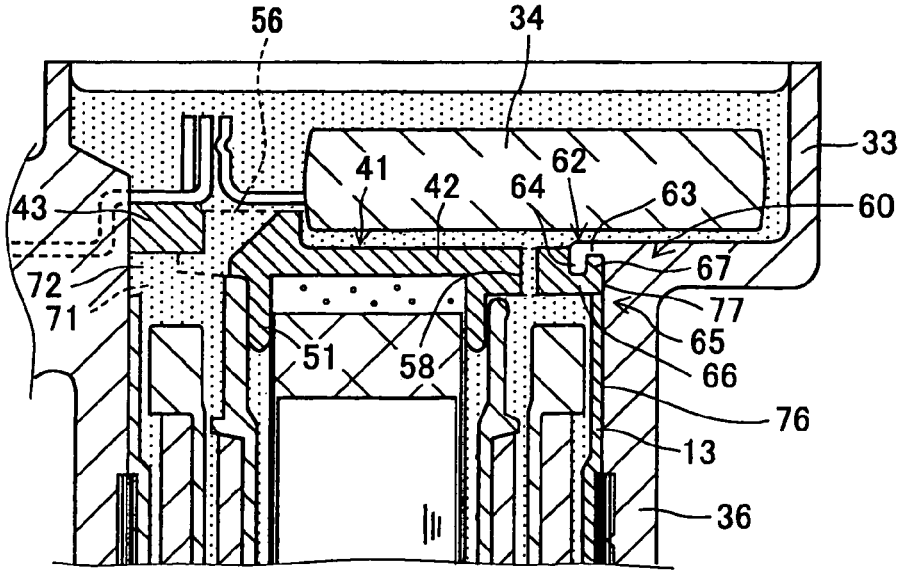
FIG. 2 is an enlarged cross-sectional view of a principal portion of FIG. 1.

As shown in FIGS. 1 and 2, the control portion 30 includes the second housing 32 and the igniter 34 installed in the second housing 32. The second housing includes the install portion 33, the fitting portion 36 and a connector portion 38. The install portion 33 has an approximately box shape to install the igniter 44 therein. The connector portion 38 is disposed at a radially outer side of the install portion 33 and holds the terminal 39. The fitting portion 36 is disposed at a lower side of the install portion 33 and is fitted to the cylinder top portion 13 of the first housing 12 to cover a top end portion of the outer peripheral core 25. The second housing 32 has the first engaging portion 62 on an inner circumferential face of a step portion 61 disposed between the install portion 33 and the fitting portion 36.

The holder 41 is laid over the ends of the center core 15, a secondary coil 17 and a primary coil 21. The holder 41 has a disc-shaped body portion 42, a cylinder portion 51 protruding over a lower face of the body portion 42 and a second engaging portion 65 formed at an outer periphery of the body portion 42. The body portion 42 is put on a top end face of the center core 15 to insert the cylinder portion 51 into a gap between the center core 15 and the secondary spool 28 and to engage the second engaging portion 65 with the first engaging portion 62 of the second housing 32.

Figure 3:
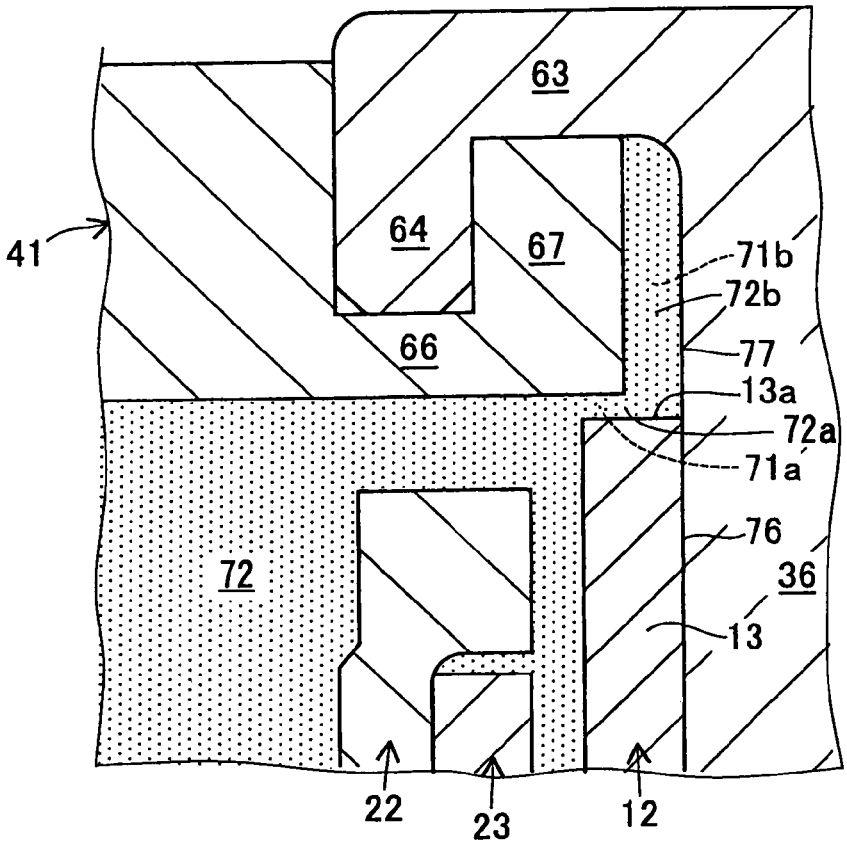
FIG. 3 is a further enlarged cross-sectional view of a principal portion of FIG. 2.

A fitting structure of the holder 41 and the coil portion 10 will be described in detail. As shown in FIGS. 2 and 3, the first engaging portion 62 of the second housing 32 has a generally L-shaped cross-section and extends along a part of the inner circumferential face of the step portion 61. The first engaging portion 62 includes a first portion 63 protruding radially inward over the inner circumferential face of the step portion 61 and a second portion 64 protruding over a lower face of the first portion 63 in the longitudinal direction. The first and second portions 63, 64 form a groove. The second engaging portion 65 of the holder 41 has a generally L-shaped cross-section and extends along a part of the outer circumferential face of the holder 41. The second engaging portion 65 includes a first portion 66 protruding radially outward from the outer circumference of the holder 41 and a second portion 67 protruding from an upper face of the first portion 66. The first and second portions 66, 67 form a groove.

Then, the first engaging portion 62 of the step portion 61 engages with the groove of the holder 41, and the second engaging portion 65 of the holder 41 engages with the groove of the step portion 61. Accordingly, the crack extension restrictor 60 is formed above a fitting faces 76 and the cylinder top portion 13 of the first housing 12.

The secondary winding 19 and the primary spool 22 forms a gap therebetween. The primary winding 23 and the first housing 12 forms another gap therebetween. The center core 15 and the secondary spool 18 or the center core 15 and the holder 41 each form gaps therebetween. These gaps communicate with each other to form an airtight annular first cavity 71. Epoxy resin charged in the annular first cavity 71 cures by a heat process to form a ring-shaped first insulating resin 72.

The disk-shaped holder 41 installs the rectangular igniter 34 therein to offset the igniter 34 relative to a center thereof (rightward in FIG. 1). The holder 41 locates the left ridge of the igniter 34 at a left side of the center thereof. The holder 41 has a projection 43 in which a resin-charging hole 56 is formed. The resin-charging hole 56 communicates with a left peripheral portion of the first cavity 71. The holder 41 further has an air vent 58 at a body portion 42 thereof. The air vent 58 is located below the igniter 58 and communicates with a right peripheral portion of the first cavity 71.

(Assembly)

The ignition coil is assembled as follows. The center core 15, the secondary coil 17 and the primary coil 21 are installed in the first housing 12, then the holder 41 is put on the first housing 12. The igniter 34 is installed in the install portion 33 of the second housing 32. The fitting portion 36 of the second housing 32 is press-fitted to the cylinder top portion 13 of the first housing 12 to bring the fitting portion 36 into an intimate contact with the cylinder top portion 13 at the fitting faces 76. Then, the first fitting portion 62 provided at the step portion 61 of the second housing 32 is engaged with the second engaging portion 65 of the holder 41.

Then, keeping the first cavity 71 at a negative pressure, a liquid epoxy resin is charged in a second cavity 73 in the install portion 33. The epoxy resin is drawn into the resin-charging hole 56 and charged from an upper portion to a lower portion and from the left peripheral portion to the right peripheral portion in the first cavity 71. Thus, the epoxy resin is charged in the gap between the secondary winding 19 and the primary spool 22, the gap between the primary winding 23 and the first housing 12, the gap between the center core 15 and the secondary spool 18 and the gap between the center core 15 and the holder 41. While the epoxy resin is charged in the first cavity 71, an air in the first cavity flows through the air vent 58 to the second cavity 73. The epoxy resin charged in the first cavity 71 is cured to be a first insulating resin 72. The epoxy resin charged in the second cavity 73 is cured to be a second insulating resin 74.

The charging process of the epoxy resin into the first cavity 71 will be described in detail. When the liquid epoxy resin is charged into the first cavity 71 in a state of attaching the holder 41 to the second housing 32, a charging pressure pushes the holder 41 upward. Here, the first engaging portion 62 of the second housing 32 and the second engaging portion 65 of the holder 41 each have dimensional errors. Thus, as shown in FIG. 3, the holder 41 pushed upward by the liquid insulating resin generates a gap 71*a* between the cylinder top portion 13 of the body housing 12 and a lower face of the second portion 67 of the holder 41, a gap 71*b* between the inner circumferential face of the fitting portion 36 and the outer circumferential face of the second portion 67, etc. The epoxy resin filled in the gap 71*a*, 71*b* is cured to be the insulating resins 72*a*, 72*b*.

Dimensions and tolerances of the first engaging portion 62 of the second housing 32 and the second engaging portion 65 of the holder 41 and an charging condition of the insulating resin may generate both the gaps 71*a*, 71*b* or may generate any one of the gaps 71*a*, 71*b*. As a result, the insulating resin may be charged into both the gaps 71*a*, 71*b* or may be charged into any one of the gaps 71*a*, 71*b*. The adhering faces 77 is formed at a contact portion of the inner circumferential face of the fitting portion 36 and the insulating resin 72*a*, 72*b*. However, the first and second engaging portions 62, 65 forming the crack extension restrictor restrict an extension of the crack starting at a top end 13*a* of the cylinder top portion 13 and extending along the adhering faces 77. The effects thereof will be described below in detail.

(Effects)

The ignition coil according to the present embodiment has the following advantages. Firstly, as shown in FIGS. 2 and 3, a gap generation and/or a crack generation is restricted at the adhering faces 77 of the inner circumferential face of the fitting portion 36 of the second housing 32 and the outer circumferential face of the insulating resin 72. Epoxy resin forming the insulating resin 72 disposed at a radially inner side has a coefficient of linear thermal extension smaller than that of PBT forming the second housing 32 at a radially outer side. Thus, when the insulating resin 72 suffers a thermal stress, a deformation of the insulating resin 72 is relatively small in the radial direction while a deformation of the fitting portion 36 is relatively large in the radial direction. Accordingly, the adhering faces 77 therebetween is hardly detached from each other to restrict the gap generation.

Secondly, even if a crack has been generated, the crack extension restrictor 60 restricts the crack to extend upward from the step portion 61 and the holder 41. That is, the first engaging portion 62 extending radially inward over the step portion 61 and second engaging portion 65 extending radially outward over the outer periphery of the holder 41 are laid over above the top end 13*a* of the cylinder top portion 13 to increase a stiffness thereat. Thus, the crack extension restrictor restricts the crack not to extend upward. Accordingly, the crack does not extend upward to reach the second insulating resin 74 charged in the install portion 33 of the second housing 32.

<Modification of the First Embodiments, Other Embodiments>

In the followings, a modification of the first embodiment and other embodiments will be described. Each of these embodiments has a crack extension restrictor differently configured from that in the first embodiments and has substantially the same configurations as the first embodiment except for the crack extension restrictor. Thus, the following descriptions focus on the crack extension restrictor. The descriptions of other configurations recites that of the first embodiment in accordance.

(1) A Modification of the First Embodiment

Figure 4:
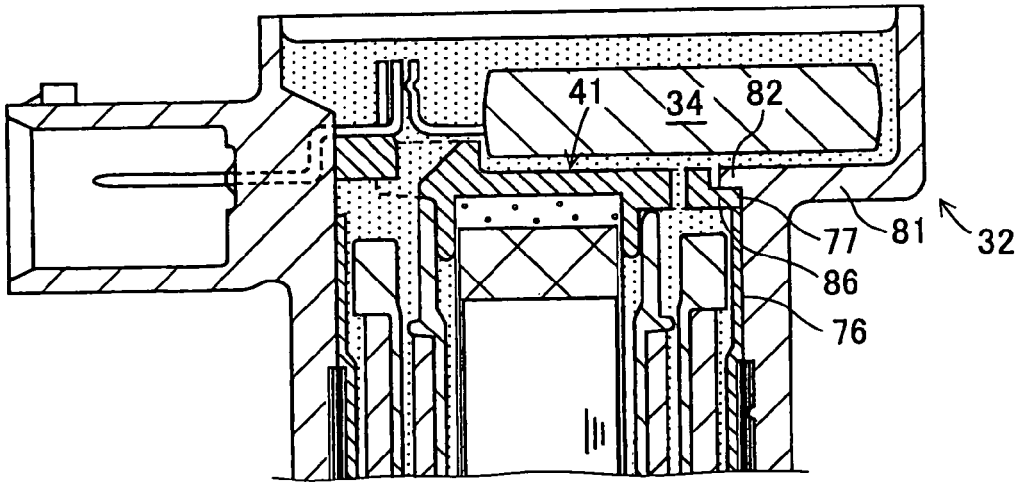
FIG. 4 is a cross-sectional view of an ignition coil for an internal combustion engine according to a modification of the first embodiment.

FIG. 4 depicts a modification of the first embodiment. The modification of the first embodiment has an assembly of the protruding portion 82 of the step portion 81 of the second housing 32 and the protruding portion 86 of the holder 41 that is different from that in the first embodiment. In the first embodiment, the first engaging portion 62 of the step portion 61 and a second engaging portion 65 of the holder 41 engages with each other. In the modification of the first embodiment, however, the protruding portion 82 protruding over the step portion 81 is disposed at an upper position and the protruding portion 86 protruding over the holder 41 is disposed at a lower position. The protruding portions 82, 86 overlap each other. The modification of the first embodiment has a further advantage that the protruding portions 82, 86 having simple shapes enable to form and assemble them easier.

(2) Second Embodiment

Figure 5:
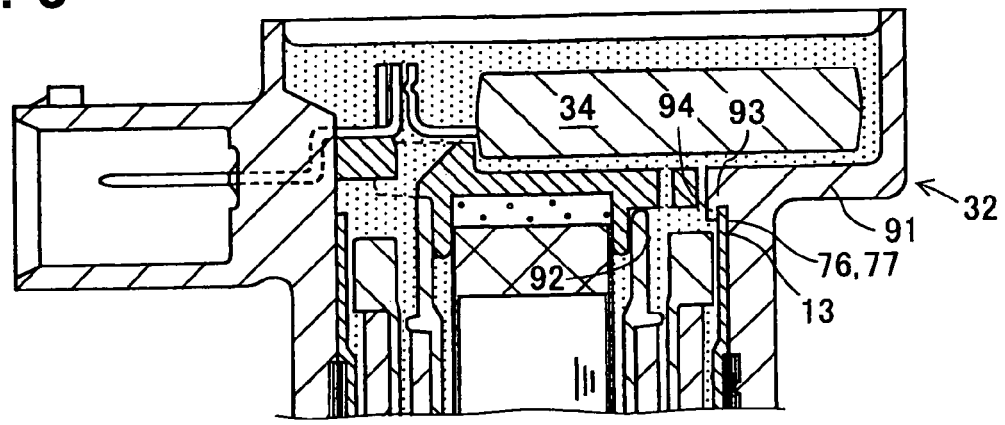
FIG. 5 is a cross-sectional view of an ignition coil for an internal combustion engine according to a second embodiment of the present invention.

As shown in FIG. 5, an ignition coil according to a second embodiment has a L-shaped portion 92 extending by a predetermined length along an inner circumferential face of the step portion 91 of the second housing 32. The L-shaped portion 82 includes a first portion 93 protruding radially inward and a second portion 94 extending downward in the longitudinal direction. A groove (not shown) formed by the first and second portions 93, 94 holds the cylinder top portion 13 of the first housing 12. The L-shaped portion 92 is disposed above the fitting faces 76 and the adhering faces 77. The second embodiment has a further advantage to simplify the shape and structure of the crack extension restrictor 60 without refining a shape of the holder 41.

(3) A Modification of the Second Embodiment

Figure 6:
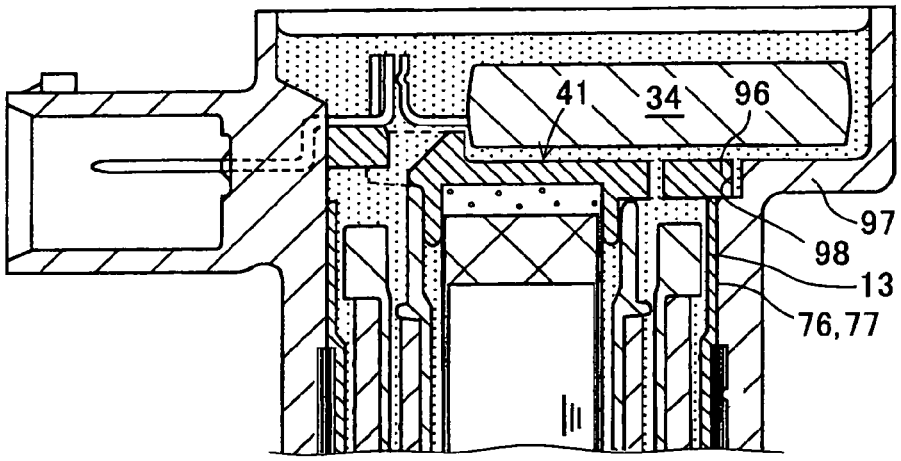
FIG. 6 is a cross-sectional view of an ignition coil for an internal combustion engine according to a modification of the second embodiment.

As shown in FIG. 6, an ignition coil according to a modification of the second embodiment has a protruding portion 96 protruding radially outward over a part of the outer circumferential face of the holder 41 to extend by a predetermined length in the circumferential direction. The protruding portion 96 is disposed above the fitting faces 76 and the adhering faces 77. In accordance with the protruding portion 96, the step portion 97 is provided with a notch 98 on the inner circumferential face thereof to support a lower face of the protruding portion 96. This modified embodiment of the second embodiment has a further advantage to simplify the shape and structure of the crack extension restrictor by providing the step portion 97 only with the notch 98.

(4) Third Embodiment

Figure 7:
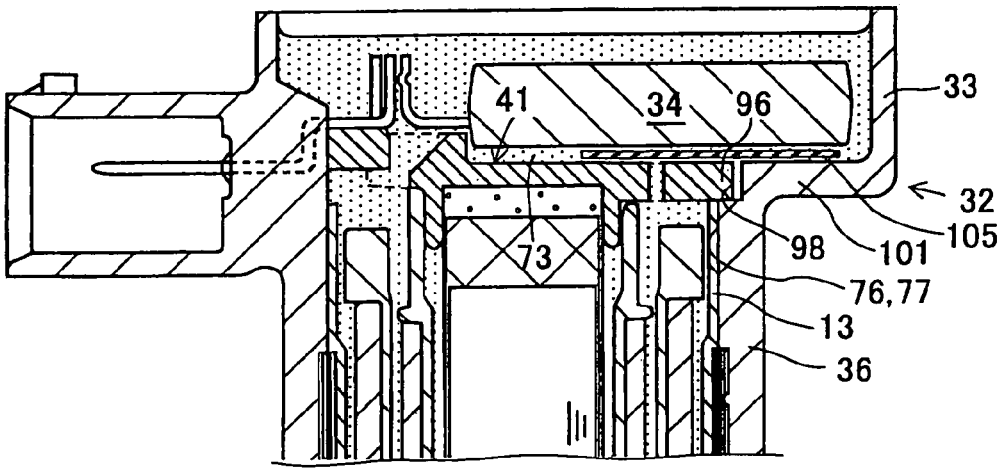
FIG. 7 is a cross-sectional view of an ignition coil for an internal combustion engine according to a third embodiment of the present invention.

As shown in FIG. 7, an ignition coil according to a third embodiment has a tape 105 embedded in the insulating resin 73 between the igniter 34 installed in the second housing 33 and the holder 44. The tape 105 can be set in the second housing 32 before charging the epoxy resin, and disposed above the fitting faces 76 and the adhering faces 77. Similar to the configuration shown in FIG. 5, the notch 98 of the step portion 101 supports the protruding portion 96 of the holder 41. The third embodiment has a further advantage that the tape 105 and the protruding portion 96 of the holder 41 can restrict the crack extension more securely.

(5) Modifications of the First to Third Embodiments

Figure 8A:
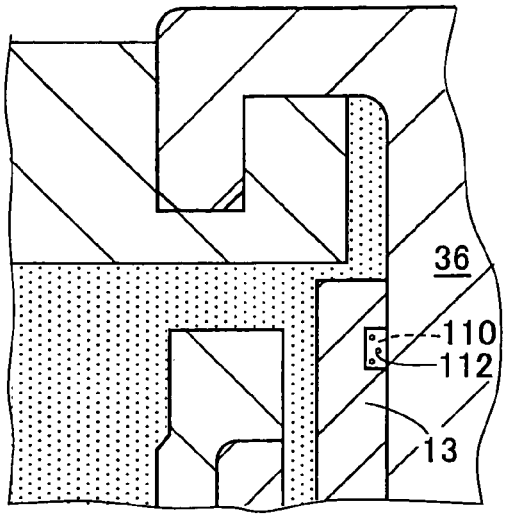
FIG. 8A is a cross-sectional view of an ignition coil for an internal combustion engine according to a modification of the first to third embodiment.
Figure 8B:
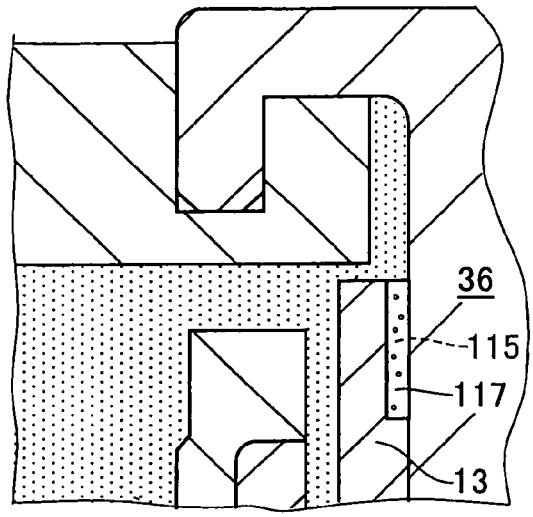
FIG. 8B is a cross-sectional view of an ignition coil for an internal combustion engine according to another modification of the first to third embodiment.
Figure 9:
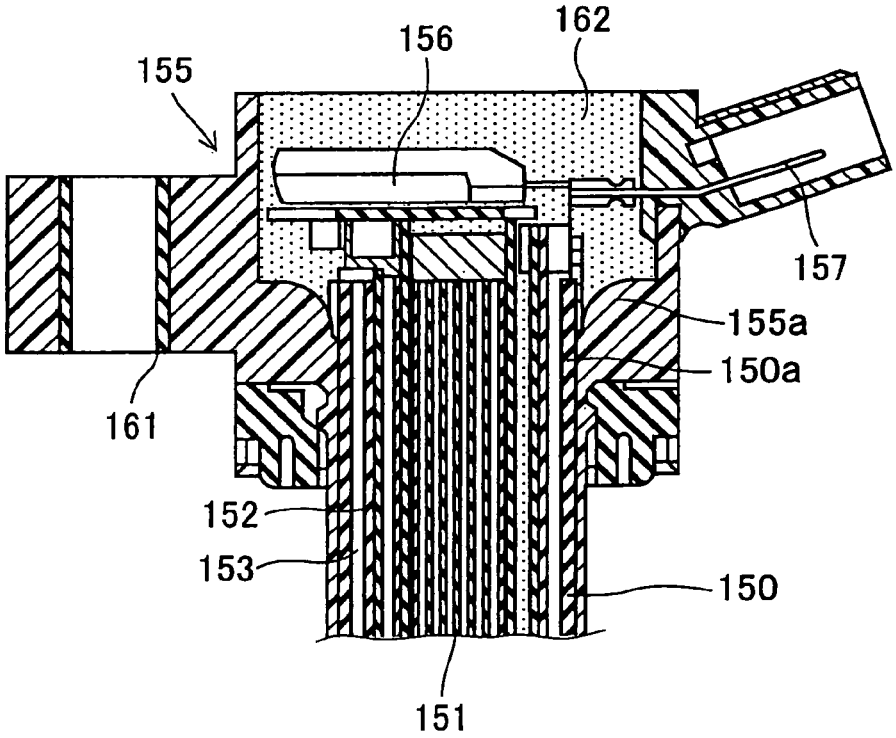
FIG. 9 PRIOR ART
FIG. 9 is a cross-sectional view of a conventional ignition coil for an internal combustion engine.

FIGS. 8A and 8B depict a common modifications of the first to third embodiments. In the modifications of the first to third embodiments, an adhesive 112, 117 accumulated in an adhesive accumulating cavity 110, 115 is supplied to the fitting faces to secure an fitting quality between the first and second housings. As shown in FIG. 8A, the cylinder top portion 13 of the first housing 12, to which the fitting portion 36 of the second housing 32 is fitted, is provided with a plurality of depressions 110 accumulating the adhesive 112 therein. When the fitting portion 36 is fitted to the cylinder top portion 13, the adhesive 112 flows out of the depressions 110 to the outer circumferential face of the top cylindrical portion 13 and the inner circumferential face of the fitting portion 36, namely, the fitting faces 76. This secures the fitting quality between the fitting portion 36 and the cylinder top portion 13. As shown in FIG. 8B, the adhesive accumulation cavity accumulating the adhesive 117 therein may be implemented by one or a plurality of grooves 115 extending by a predetermined length along the circumferential or longitudinal direction of the cylinder top portion 13.

The adhesive may be alternated by the epoxy resin charged in the first and second cavities 71, 73. That is, in a case shown in FIG. 8A, the epoxy resin is charged also in the depression 110 when it is charged in the first cavity 71, etc. In a case shown in FIG. 8B, by forming a passage in communication with the grooves 115, it is possible to charge the epoxy resin through the passage to the grooves 115 when it is charged in the first cavity 71, etc.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition coil for an internal combustion engine comprising:

a cylinder-shaped first housing enclosing a center core, a primary coil disposed outside of the center core and a secondary coil disposed outside of the center core therein;

a second housing having an install portion and a cylinder-shaped fitting portion fitted to an outer circumference of a top end portion of the first housing;

a holder laid over top ends of the primary and secondary coils to define relative positions thereof;

a ring-shaped insulating resin charged in an annular cavity defined at least by an uppermost portions of the primary and secondary coils, the top end portion of the first housing, the fitting portion of the second housing and the holder and in an intimate contact with the fitting portion, and a crack extension restrictor formed by a part of the fitting portion of the second housing and a part of the holder and disposed above the fitting faces of the fitting portion and the top end portion to restrict a crack extension starting at a top end of the top end portion and extending along the adhering faces of the fitting portion and the insulating resin toward the install portion.

2. The ignition coil according to claim 1, wherein the crack extension restrictor includes:

a first engaging portion protruding radially inward over an inner circumference of the fitting portion; and a second engaging portion extending radially outward over an outer circumference of the holder to overlap and engage with the first engaging portion.

3. The ignition coil according to claim 1, wherein the crack extension restrictor includes:

a first extending portion protruding radially inward over an inner circumference of the fitting portion; and a second extending portion extending radially outward over an outer circumference of the holder to overlap the first engaging portion.

4. The ignition coil according to claim 1, further comprising an adhesive accumulation cavity on the outer circumference of the top end portion to accumulate an adhesive to adhere the fitting portion to the top end portion.

5. An ignition coil for an internal combustion engine comprising:

a cylinder-shaped first housing enclosing a center core, a primary coil disposed outside of the center core and a secondary coil disposed outside of the center core therein;

a second housing having an install portion and a cylinder-shaped fitting portion fitted to an outer circumference of a top end portion of the first housing;

a holder laid over top ends of the primary and secondary coils to define relative positions thereof;

a ring-shaped insulating resin charged in an annular cavity defined at least by an uppermost portions of the primary and secondary coils, the top end portion of the first housing and the fitting portion of the second housing and in an intimate contact with the fitting portion, and a crack extension restrictor formed by a part of the second housing or a part of the holder and disposed above the fitting faces of the fitting portion and the top end portion to restrict a crack extension starting at a top end of the top end portion and extending along the adhering faces of the fitting portion (36) and the insulating resin toward the install portion.

6. The ignition coil according to claim 5, wherein the crack extension restrictor is any one of:

a first extending portion protruding radially inward over an inner circumference of the fitting portion; and a second extending portion extending radially outward over an outer circumference of the holder.

7. The ignition coil according to claim 5, further comprising an adhesive accumulation cavity on the outer circumference of the top end portion to accumulate an adhesive to adhere the fitting portion to the top end portion.

8. An ignition coil for an internal combustion engine comprising:

a cylinder-shaped first housing enclosing a center core, a primary coil disposed outside of the center core and a secondary coil disposed outside of the center core therein;

a second housing enclosing an igniter therein and a cylinder-shaped fitting portion fitted to an outer circumference of a top end portion of the first housing;

a ring-shaped insulating resin charged in an annular cavity defined at least by an uppermost portions of the primary and secondary coils, the top end portion of the first housing and the fitting portion of the second housing and in an intimate contact with the fitting portion, and a crack extension restrictor disposed below the igniter in the second housing and above a fitting faces of the fitting portion and the top end portion to restrict a crack extension starting at a top end of the top end portion and extending along the adhering faces of the fitting portion and the insulating resin toward the igniter.

9. The ignition coil according to claim 8, wherein the crack extension restrictor includes a tape having a sheet shape and at least embedded in the insulating resin in the second housing or adhered on a lower face of the igniter.

10. The ignition coil according to claim 8, further comprising an adhesive accumulation cavity on the outer circumference of the top end portion to accumulate an adhesive to adhere the fitting portion to the top end portion.

* * * * *